US005839167A

United States Patent [19]

Wagner

[11] Patent Number: 5,839,167

[45] Date of Patent: Nov. 24, 1998

[54] ARTICLE CARRYING CLIP

[76] Inventor: Scott J. Wagner, 1210 Avenue F, Fort Madison, Iowa 52627

[21] Appl. No.: 427,744

[22] Filed: Apr. 24, 1995

[51] Int. Cl.[6] ..... A44B 21/00

[52] U.S. Cl. ..... 24/3.7; 24/3.12; 24/306

[58] Field of Search ..... 24/442, 3.1, 306, 24/67 R, 67.9, 3.5, 3.7, 3.12; 224/901, 252, 269, 230; 2/251, 145

[56] References Cited

U.S. PATENT DOCUMENTS

| | | | |
|---|---|---|---|
| 3,128,514 | 4/1964 | Parker et al. | 24/306 X |
| 3,131,445 | 5/1964 | Lorber | 24/67.9 |
| 3,374,508 | 3/1968 | Slimovitz | 24/3.1 |
| 4,403,366 | 9/1983 | Lucke | 24/306 X |
| 4,480,356 | 11/1984 | Martin | 24/67.9 |
| 4,953,770 | 9/1990 | Bond, Sr. | 224/901 X |
| 5,143,371 | 9/1992 | Strahan | 224/901 X |
| 5,481,784 | 1/1996 | Sinaiko | 24/67.9 |

*Primary Examiner*—James R. Brittain
*Attorney, Agent, or Firm*—Kent A. Herink; Brian J. Laurenzo

[57] ABSTRACT

An article carrying device releasably attachable to clothing or an accessory of a user. A clip is provided with a section of hook and loop fastening material that will releasably retain an article that has either a cooperating section of hook and loop fastening material or a texture which will be retained by said section of hook and loop fastening material. The article is releasably attached to the clip by alignment and manual pressing of the section of hook and loop fastening material on the clip and the cooperating portion of the article. The carried article is easily and quickly accessible to the user by removing from the clip by manual pulling and separation. The article carrying clip is particularly suited for retaining golf gloves when temporarily removed by a golfer, for example while putting.

8 Claims, 1 Drawing Sheet

ARTICLE CARRYING CLIP

BACKGROUND OF THE INVENTION

1. Field of the Invention

The invention relates generally to clips for carrying articles on the person of a user and, more specifically to a clip that supports a section of hook and loop fastening material, wherein the clip is releasably attached to the person of the user, such as on the top edge of a pocket or waistband.

2. Background of Prior Art

It is frequently desired to be able to carry on the person an article, such as a hand tool, so that the article is easily and readily available for use and yet can be transported by the person without substantial impediment to the freedom of movement of the person or to the free use of the hands of the person while not using the article. Examples are pliers, measuring tapes, keys, knives, gloves, wrenches, towels, or any other small, fairly light-weight article that needs to be accessible to its user from time-to-time.

A particular example is a golf glove. A majority of golfers use at least one glove to protect their hand or hands from calluses, blisters and the like and to provide a better grip on the golf club. Many golfers, however, remove the glove to improve the feel of the club while putting. A concern is what to do with the glove while it is not being worn. Since both hands are used to grip the putter, the removed glove cannot be held in the hands. If the golfer does not have pockets, the glove must be put on the ground or some other place where it can easily be forgotten or lost.

A number of prior art devices have addressed this problem. For example, U.S. Pat. No. 5,186,373 describes a multiple piece connector assembly which uses a pair of permanent magnets to hold the connector assembly in its working position. The connector assembly presents a surface portion of a hook and loop fastening material to which a mating portion of such material found on most golf gloves can be releasably attached.

A device for releasably mounting a towel on the person of a user is described in U.S. Pat. No. 4,403,366. A clip for attachment to the belt, pants, or the like of a user supports a fixed piece of hook and loop fastening material that releasably holds a towel on which has been placed a cooperating piece of the hook and loop fastening material.

In U.S. Pat. No. 3,374,508, a necktie anchor is disclosed, including a clip for releasable attachment to the shirt of a user. The clip supports a strip of hook and loop fastening material that attaches to a cooperating strip on the back side of the necktie.

SUMMARY OF THE INVENTION

The invention consists of a clip that is attached to the clothes of a user and which provides a section of hook and loop fastening material by which an article which also includes a mating section of hook and loop fastening material can be carried on the person of the user and remain easily and quickly accessible to the user. A clip is formed of resilient material such as metal or plastic and includes an outer section and an inner section in operative connection to each other. A strip of hook and loop fastening material is secured to the outer section with the working face of the hook and loop fastening material facing away from the inner section. The clip is releasably attached to the clothes or accessories of the user by inserting a free edge of the clothing or accessory between the inner section and the outer section. The clip deforms to accommodate the clothing or accessory and resiliently grips the clothing or accessory to hold itself in its operative position. An article to be carried on the clip is releasably attached by positioning its section of hook and loop fastening material adjacent the hook and loop fastening material of the clip and pressing the two together. The article can be easily and quickly separated from the slip by manual pulling of the mating sections of hook and loop fastening material apart.

In the preferred embodiment, the article is a golf glove which includes as originally manufactured a section of hook and loop fastening material. The clip is conveniently placed on the belt, waistband or top edge of a pocket.

REFERENCE NUMERALS IN DRAWINGS

Figure 1:
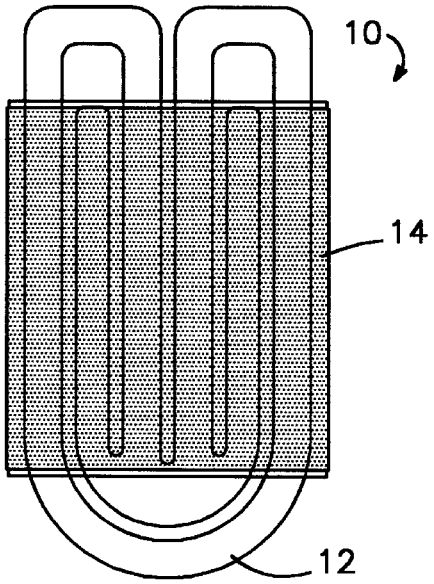
FIG. 1 is a front view of the article carrying clip of the present invention.

10 article carrying clip
12 clip
14 hook and loop fastening material
16 outer section of clip
18 inner section of clip
20 common edge of clip
22 first linear side member of outer section of clip
24 second linear side member of outer section of clip
26 U-shaped portion of inner section of clip
28 first linear side member of inner section of clip
30 second linear side member of inner section of clip
32 pocket

DETAILED DESCRIPTION OF A PREFERRED EMBODIMENT

Illustrated in FIG. 1, generally at 10, is an article carrying clip of the present invention.

Figure 2:
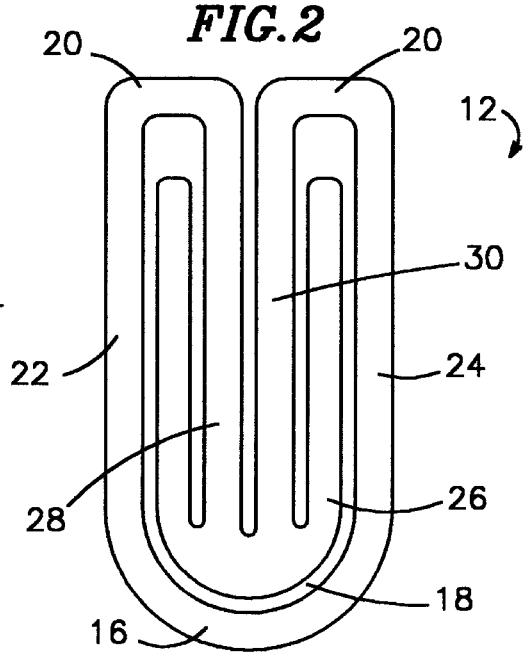
FIG. 2 is a front view of the clip of the article carrying clip of FIG. 1.

The article carrying clip 10 includes a clip 12 and a section of hook and loop fastening material, such as Velcro®, 14. The clip 12 includes an outer section 16 and an inner section 18 (FIG. 2) formed of a resilient material such as metal or plastic. The two sections 16 and 18 are operably connected to each other so that their free ends can be displaced apart to accommodate a relatively thin object or portion of an object which will then be releasably captured by friction of the hook and loop fastening material 14 and the resiliency of the clip 12.

In the preferred embodiment, the clip 12 is formed of a single piece, with the outer and inner sections being interconnected to each other at a common edge 20. The outer section 16 is substantially U-shaped having two linear side members 22 and 24. The inner section 18 includes 20 a U-shaped portion 26 that is linked to the common edge 20 by a pair of linear members 28 and 30.

Figure 4:
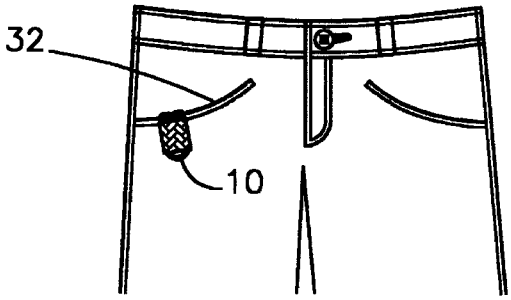
FIG. 4 is a front view of the article carrying clip shown attached over the top edge of a pant's pocket.
Figure 3:
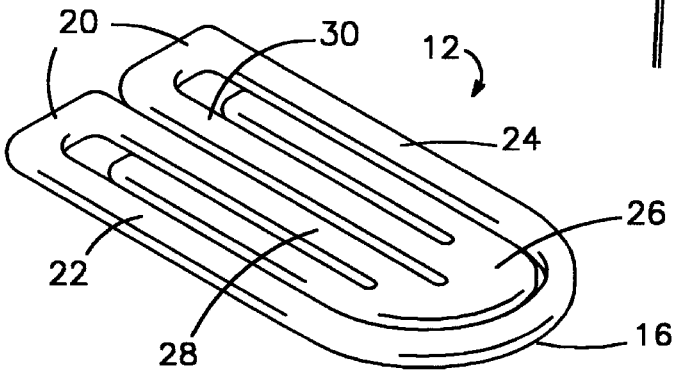
FIG. 3 is a perspective view of the clip of FIG. 2.

To assemble the article carrying clip 10, a strip of a hook and loop fastening material, such as Velcro®, somewhat longer than twice the width of the clip 12 is folded with the surface that presents hooks facing outwardly and the ends of the strip folded underneath and toward each other. The folded strip is then slipped over the outer section 16 of the clip 12 so that the free ends of the strip are positioned between the outer section 16 and the inner section 18. Glue or the like is then used to secure the free ends of the strip to the back side of the strip in the region interior to the outer section 16 of the clip. Specifically, the hook and loop fastening material is available with adhesive already applied to the back or non-operative side. The section of hook and loop fastening material 14 is thereby securely attached to the clip 12. The completed article carrying clip 10 may be releasably attached to any free edge of a user's clothing or personal accessories, such as the top edge of a pocket 32 (FIG. 4), a waistband, a belt, a shirt pocket, or a shirt placket. The design and resiliency of the clip 12 permit the article carrying clip 10 to be used on free edges of both thin fabric materials, such as light weight cotton, poplin, and the like, and thick fabrics, such as denim, twills, corduroy the like, without being obtrusive to the user.

The article carrying clip 10 is most typically used to carry articles which have a cooperating section of a hook and loop material that is manually pressed on the section of hook and loop material 14 where it will be retained until it is manually pulled or separated therefrom by the user. For example, in the case of a golf glove, the typical method of adjusting the fit and retaining the glove on the hand of a user are a pair of cooperating sections of hook and loop material. Accordingly, when the golf glove is removed, a section of cooperating hook and loop material is available for releasable attachment to the section of hook and loop material 14 of the article carrying clip 10. Articles suitable for carrying that do not already have a cooperating section of hook and loop material can be provided with the same in a suitable fashion. For example, a baseball cap could have a section of hook and loop material sewn onto the bill, a measuring tape could have a section of hook and loop material glued onto one of its sides, and so on. In the case of certain fabric articles, such as towels, the surface of the fabric may be of a texture that would cause it to be retained on the hook and loop material 14 without the addition of separate hook and loop material. In each case, the article is easily and conveniently accessible for use and can be readily and conveniently returned to the carrying position.

Although the invention has been described with respect to a preferred embodiment thereof, it is to be also understood that it is not to be so limited since changes and modifications can be made therein which are within the full intended scope of this invention as defined by the appended claims.

I claim:

1. An article carrying clip for releasable attachment to a free edge of an article of clothing of a user and for carrying an article adapted for releasable attachment to hook and loop fastening material, comprising;

(a) a clip having a pair of opposing side members and an inner section nested between said pair of opposing side members;

(b) a strip of hook and loop fastening material formed into a loop and positioned over said opposing side members wherein said opposing side members of said clip are enclosed within said loop of hook and loop fastening material and wherein said inner section of said clip is located outside of said loop of said hook and loop fastening material such that the operative face of said hook and loop fastening material faces away from said clip; and (c) means securing said loop of hook and loop fastening material to said clip, whereby said clip is releasably slidably attached to the free edge by inserting the free edge between said inner section and said loop of hook and loop fastening material such that the article can be manually pressed onto said operative face where it is retained until manually pulled therefrom by the user.

2. An article carrying clip as defined in claim 1, wherein the article is a golf glove.

3. An article carrying clip as defined in claim 2, wherein said face of said hook and loop fastening material presents the hook portion of said hook and loop fastening material and the article includes a portion having a texture that is releasably attachable to said hook portion.

4. An article carrying clip as defined in claim 3, wherein the article is a towel.

5. An article carrying clip as defined in claim 1, wherein said article of clothing is a belt.

6. An article carrying clip as defined in claim 1, wherein said article of clothing is a pocket.

7. An article carrying clip as defined in claim 6, wherein said pocket is made of a thin fabric material.

8. An article carrying clip as defined in claim 6, wherein said pocket is made of a thick fabric material.

* * * * *